US006229418B1

(12) United States Patent
Mueller et al.

(10) Patent No.: US 6,229,418 B1
(45) Date of Patent: May 8, 2001

(54) CIRCUIT BREAKER WITH LOCKABLE TRIP UNIT

(75) Inventors: Robert W. Mueller, Aliquippa; Wayne C. Sumpman, North Huntingdon, both of PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/376,897

(22) Filed: Aug. 18, 1999

(51) Int. Cl.[7] ..... H01H 9/02
(52) U.S. Cl. ..... 335/202; 335/172
(58) Field of Search ..... 335/6, 16, 35, 335/45, 132, 167–176, 202; 200/293–303, 43.11–43.22; 218/154–155

(56) References Cited

U.S. PATENT DOCUMENTS 4,281,359 * 7/1981 Bayer et al. ..... 361/115
4,728,914 * 3/1988 Morris et al. ..... 335/6
5,113,043 * 5/1992 Morris ..... 200/43.11
5,362,933 * 11/1994 Kutsche et al. ..... 200/401
5,870,531 * 9/1989 Danek ..... 361/93
5,910,760 6/1999 Malingowski ..... 335/167
5,936,214 * 8/1999 Phillips ..... 174/50

* cited by examiner

*Primary Examiner*—Lincoln Donovan
(74) *Attorney, Agent, or Firm*—Martin J. Moran

(57) ABSTRACT

This concerns a molded case circuit breaker having separable main contacts and an operating mechanism utilized to cause the separable main contacts to open and close. A trip unit is provided to actuate the operating mechanism in desirable circumstances. The aforementioned trip unit has disposed on an outside surface thereof, dials for adjustment of the thermal and magnetic tripping characteristics of the circuit breaker. The face of the trip unit also has a set of hinge regions disposed therein into which a plastic, transparent, hinged cover may be inserted. The top of the trip unit has a convenient ridge around the outside of the dial regions. The cover after insertion is rotated downward on to the face of the dial region and then moved transversely to abut one of the ridges. Both the cover and the surface of the dial region have bridged openings therein through which a single wire may be fed and locked in place with a solder lock at the ends of the wires. Thus the trip unit has a non-removable cover which covers the dial settings but, because the cover is transparent, the dial settings can be viewed.

7 Claims, 9 Drawing Sheets

CIRCUIT BREAKER WITH LOCKABLE TRIP UNIT

CROSS REFERENCE TO RELATED APPLICATIONS

The subject matter of this invention is related to concurrently filed, co-pending applications: U.S. pat. application Ser. No. 09/377,001, [Eaton Docket No. 97-PDC-505], filed Aug. 18, 1999, entitled "Circuit Breaker With Easily Installed Removable Trip Unit"; U.S. patent application Ser. No 09/377.013, [Eaton Docket No. 99-PDC-153], filed Aug. 18, 1999, entitled "Circuit Breaker With Externally Lockable Secondary Cover Latch"; U.S. patent Application Ser. No. 09/376,920, [Eaton Docket No. 99-PDC-221], filed Aug. 18,1999, entitled "Circuit Breaker With Combined Slot Motor, Reverse Loop And Terminal Strap"; U.S. patent application Ser. No. 09/376.248, [Eaton Docket No. 99-PDC-222], filed Aug. 18, 1999, entitled "Circuit Breaker With Combination Push-To-Trip And Secondary Cover Latch"; U.S. patent application Ser. No. 09/376.265, [Eaton Docket No. 99-PDC-223] filed Aug. 18, 1999, entitled "Multi-Pole Circuit Breaker With Multiple Trip Bars"; U.S. patent application Ser. No. 09/376.816, [Eaton Docket No. 99-PDC-225), filed Aug. 18, 1999, entitled "Circuit Breaker With Trip Unit Mounted Tripping Plunger And Latch Therefore" U.S. patent application Ser. No. 09/377,018, [Eaton Docket No. 99-PDC-226], filed Aug. 18, 1999, entitled "Circuit Breaker With Non-Symmetrical Terminal Collar"; U.S. patent application Ser. No. 09/376.815, [Eaton Docket No. 99-PDC-246], filed Aug. 18, 1999, entitled "Circuit Breaker With Side Wall Opening For A Separate Auxiliary Device Actuation Lever"; and U.S. patent application Ser. No. 09/376,254, [Eaton Docket No. 99-PDC-247], filed Aug. 18, 1999, entitled "Circuit Breaker With Dial Indicator For Magnetic Trip Level Adjustment".

BACKGROUND OF THE INVENTION

1. Field Of The Invention

The subject matter of this invention is related generally to molded case circuit breakers and more specifically to trip unit adjustment dial covers.

2. Description Of The Prior Art

Molded case circuit breakers are well known in the art as exemplified by U.S. Pat. No. 5,910,760 issued Jun. 8, 1999 to Malingowski et al., entitled "Circuit Breaker with Double Rate Spring" and assigned to the assignee of the present application. The foregoing is incorporated herein by reference.

Molded case circuit breakers include a set of separable main contacts, one of which is usually fixed and one of which is movable for automatically opening upon the occurrence of an overload or short circuit electrical current in the network which the circuit breaker is provide to protect. The separable main contacts are opened as a result of the functioning of a latched operating mechanism, which is interconnectable by way of an operating handle to a region outside of the circuit breaker. The operating handle may be used to trip the circuit breaker manually or to reset and close the circuit breaker contacts once they have been opened automatically. The reset action is required because circuit breakers must be mechanically charged to be in a state to reopen immediately upon closure in the event that the fault which cause the tripping in the first place has not disappeared. The reset action charges the circuit breaker for that purpose. Molded case circuit breakers have trip units, which are often removably insertable in the circuit breaker case.

The trip unit in addition has at least two calibratable functions, one of which is generally identified as thermal tripping and the other of which is generally identified as magnetic tripping. The trip unit includes a rotatable trip bar, which when rotated will actuate a latchable tripping operation within the operating mechanism to automatically open the circuit breaker contacts. The rotatable trip bar is usually actuated in one of two ways. The first way is in response to what is called a magnetic tripping of the circuit breaker. This occurs when the amount of current flowing through the separable main contacts of the circuit breaker is so high as to represent a potential catastrophic failure and which therefore requires exceedingly quick opening action of the circuit breaker. In such a case a electron magnetic core, which produces magnetic flux in proportion to the amount of electrical current flowing through the separable main contacts attracts a movable armature, the movement of which eventually causes the trip bar to move to thus cause the tripping action. The second tripping occurrence is in response to a relatively low amount of overload current, which eventually will cause overheating of the electrical wires in the circuit to be protected, but which does not necessitate the instantaneous action a short circuit requires and thus does not require the magnetic action spoken of previously. In this case a bi-metal element is heated by a heater element which conducts the electrical current flowing through the separable main contacts. As the bi-metal element flexes or moves it impinges upon the tripping bar causing it to flex and move correspondingly, until eventually a point is reached in which the tripping bar causes the circuit breaker to unlatch and trip automatically. Both the magnetic trip mechanism and the thermal trip mechanism usually require initial calibration.

In one half of an AC cycle, the electrical current flows through the circuit interrupter from the load by way of a terminal collar to the load terminal of the circuit breaker and from there into the trip unit where it flows through the previously mentioned heater which in turn is serially connected to the electron magnetic member of the magnetic trip device. From there it is interconnected by way of a flexible cable to one end of a moveable contact arm and from there to the main contact on the moveable contact arm. When the contact arm is closed, it is closed upon a fixed contact which is supported usually on unshaped conductor, which in turn is interconnected with a line terminal and there to the line terminal collar and finally to the electrical line. In addition the circuit breaker usually has an arc chute for assisting in diminishing the electrical arc drawn between the separating contacts during the opening operation for extinguishing of the arc. The circuit breaker also has a slot motor arrangement, which is utilized to interact magnetically with the electrical current flowing in the opening contact arm to accelerate the opening of the contact arm magnetically. The operating mechanism usually consists of a series of levers and linkages, which are interconnected with the separable main moveable contact arm, the handle mechanism, and by way of a latch arrangement with the aforementioned trip bar. Description and operation of all of the above may be found in the previous mentioned, incorporated by reference '760 patent.

Circuit breaker trip units usually have adjustment dials disposed on the face thereof, which may be adjusted previous to placing in the hands of a consumer or afterwards. Regardless, when the adjustments are made it is sometimes desirable to render further adjustment impossible or difficult. It would be advantageous if a way could be found to do this which utilized few parts and which was convenient. It would also be desirable if the way of doing this could be done immediately after the manufacturing process or in the field and if the locking feature was incorporated into what ever means is utilized to provide the protection arrangement.

SUMMARY OF THE INVENTION

In accordance with the invention there is provided a circuit interrupter having a housing. There is an operating mechanism disposed within the housing. Separable contacts are disposed within the housing in cooperation with the operating mechanism for being opened by the operating mechanism. An adjustable trip unit is disposed within the housing in cooperation with the operating mechanism for actuating the operating mechanism for opening the separable contacts. The adjustable trip unit has an adjustment portion. There is an opening in the adjustable trip unit through which the adjustment device is accessible from a region outside of the trip unit for adjustment thereof, the adjustable trip unit has a hinge region. A cover is disposed upon the trip unit and affixed to the hinge in either of two positions. The first of the two positions allows removal of and insertion of the cover from the hinge region and the second of the two positions prevents removal of the cover from the hinge region. The cover covers the dial when in the second position to prevent access to the adjustment from the region outside of the trip unit. The cover is non removable from the adjustable trip unit at the hinge in the second position. A separate lock is disposed on the cover and the trip unit for locking the cover in to the second position.

BRIEF DESCRIPTION OF THE DRAWINGS

In accordance with the invention, reference may be had to the preferred embodiment thereof, shown in the accompanying drawings in which.

DESCRIPTION OF THE PREFERRED EMBODIMENT

Figure 1:
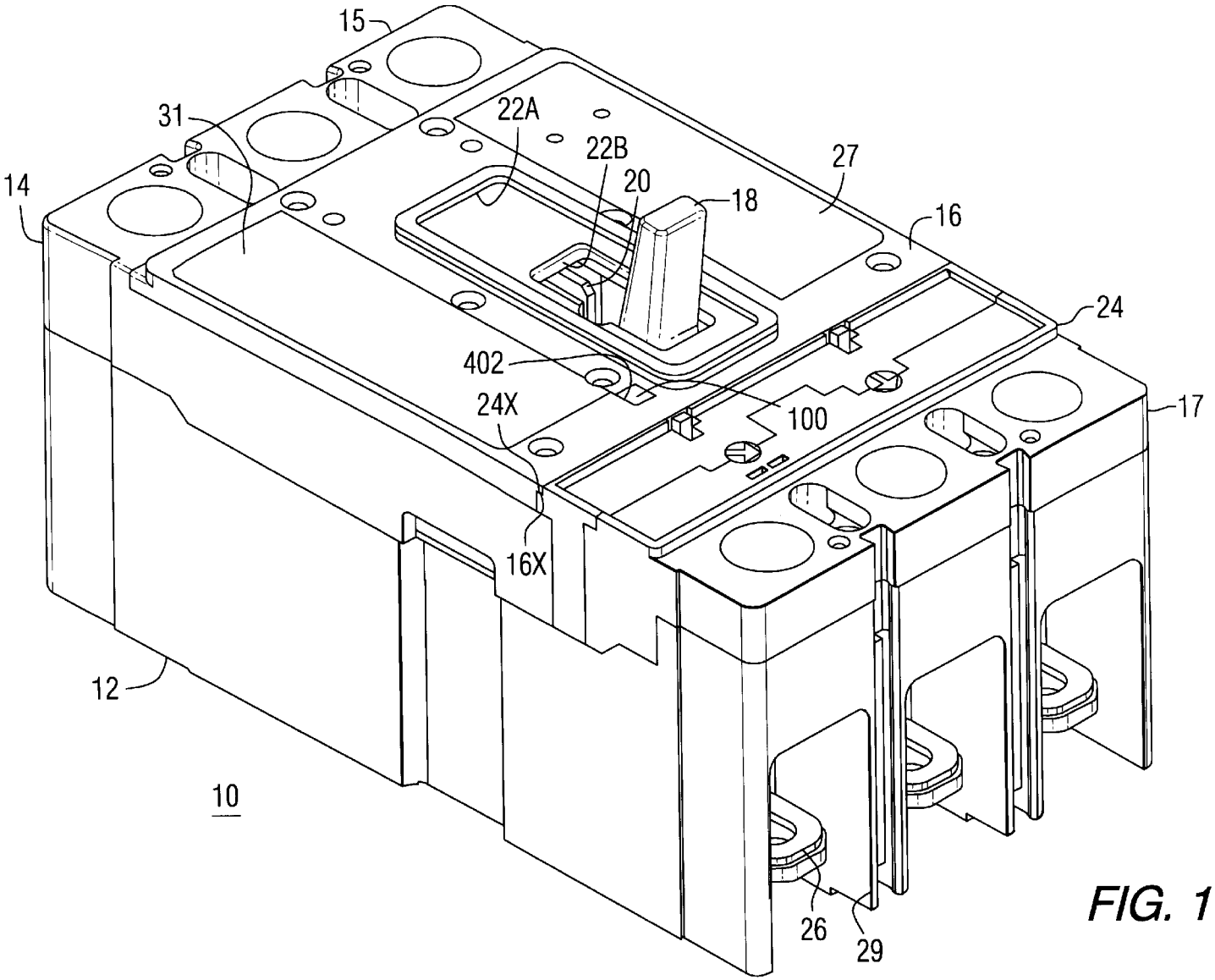
FIG. 1 is an orthogonal view of a three-phase molded case circuit breaker employing embodiments of the present invention.

Referring now to the drawings and FIGS. 1 through 4 in particular, there is shown a molded case circuit breaker or interrupter 10 having a main base 12 and primary cover 14. Attached to the primary cover 14 is a secondary cover 16. A handle 18 extends through a secondary escutcheon 22A in the secondary cover 16 and aligned primary escutcheon 22B in the primary cover 14. An operating mechanism 20 is interconnected with the handle 18 for opening and closing separable main contacts in a manner which will be described hereinafter. This circuit breaker has a line end 15 and load end 17. The circuit breaker or interrupter includes a removable trip unit 24. Removable trip unit 24 has an underlapping lip 24X, the purpose of which will be described hereinafter. There are also depicted a load terminal 26, a right side accessory region or pocket 27 and a left side accessory pocket or region 31.

Figure 2:
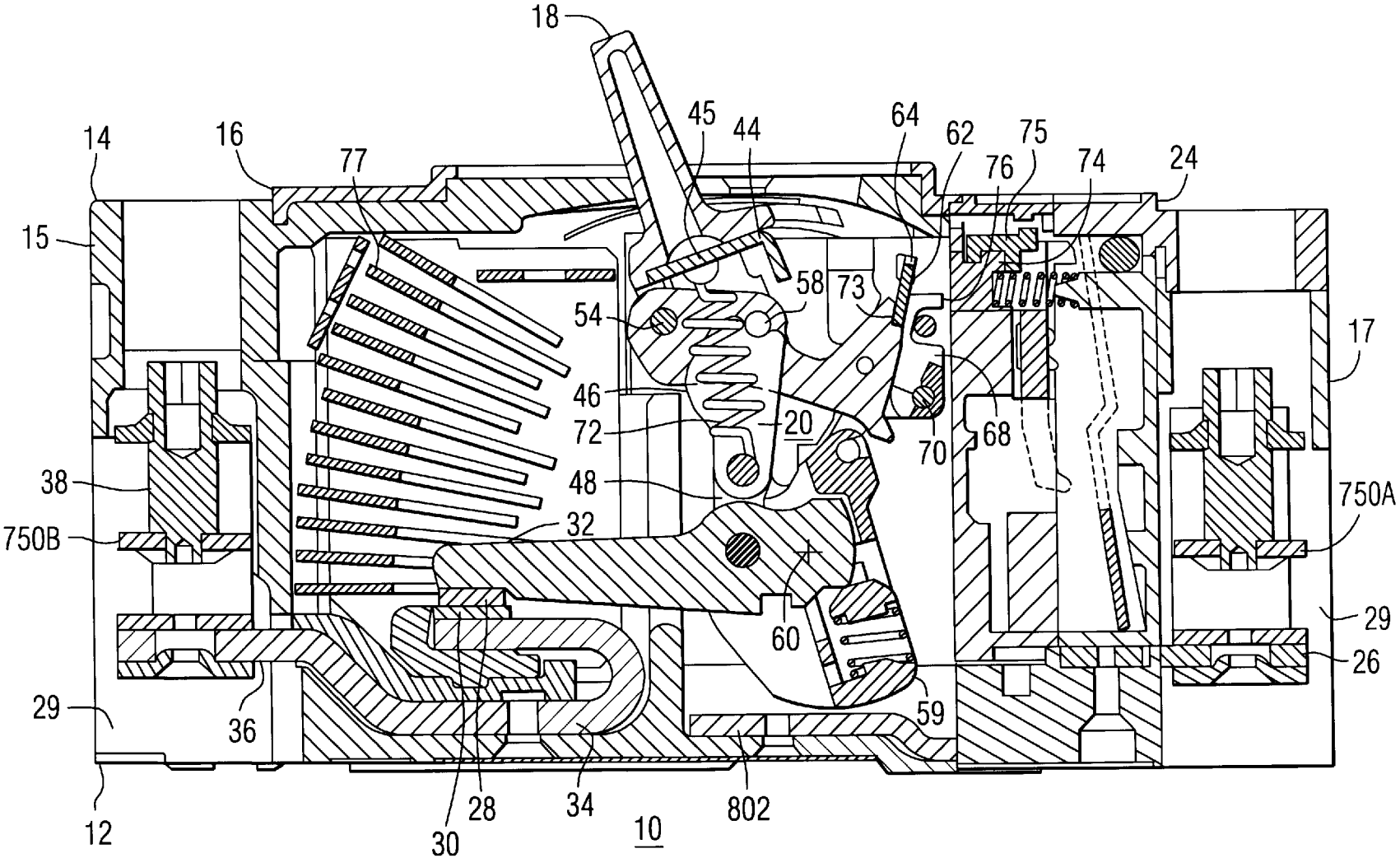
FIG. 2 is a cut away side elevation section of the circuit breaker of FIG. 1, depicting the circuit interrupter in the closed state.
Figure 3:
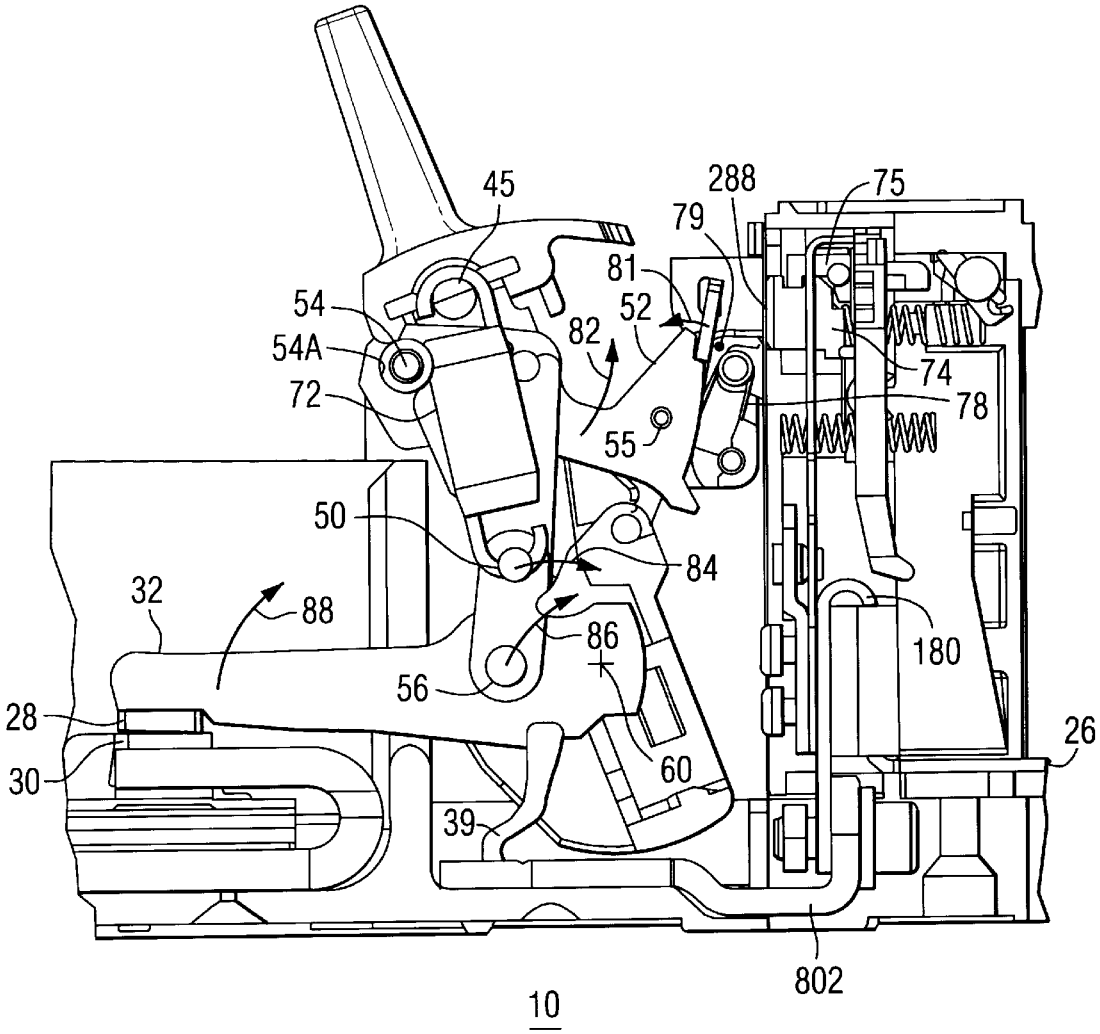
FIG. 3 is a side elevation view similar to that shown in FIG. 2, concentrating on the circuit breaker operating mechanism and trip unit.
Figure 4:
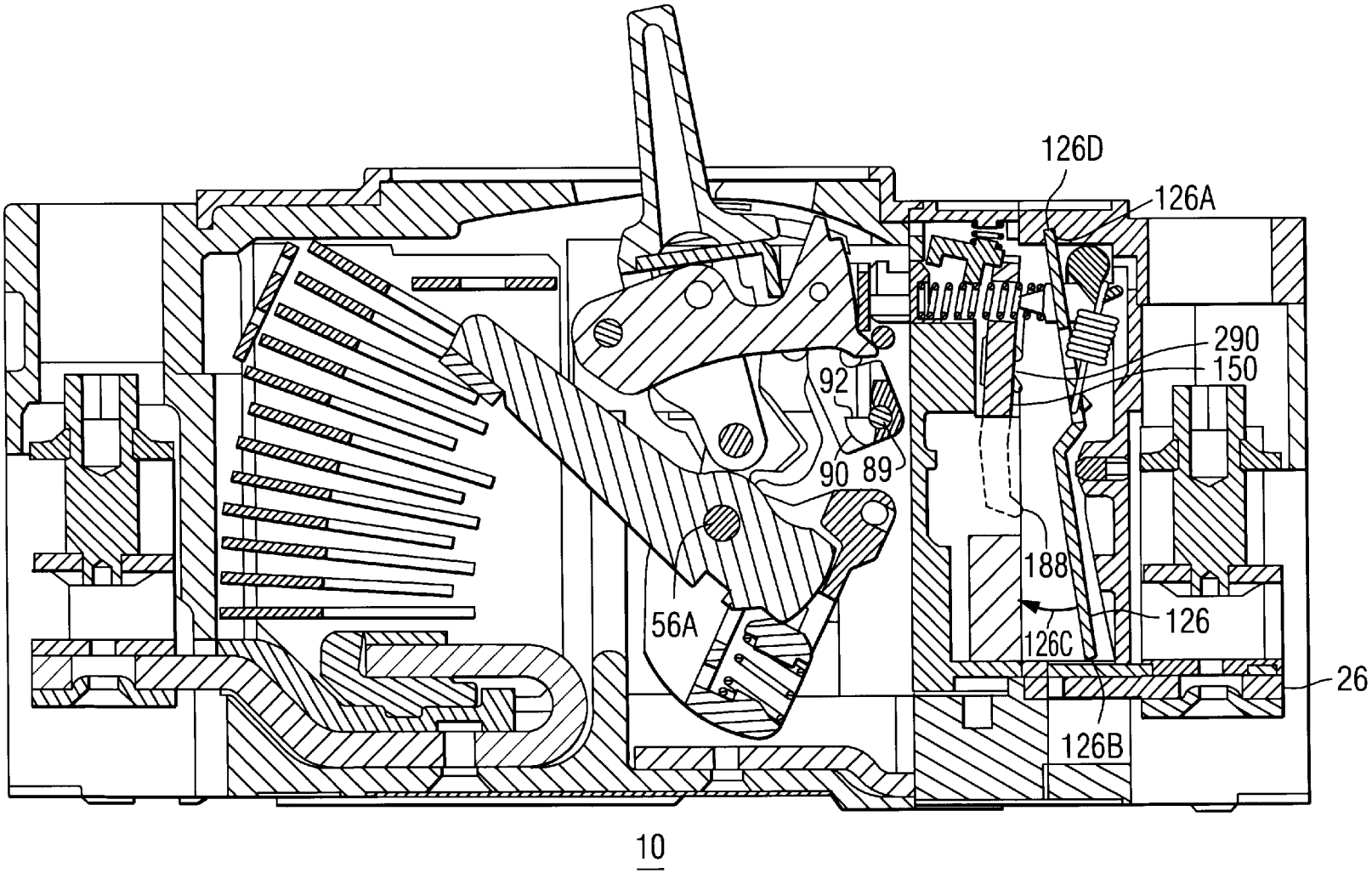
FIG. 4 is similar to FIG. 2, but depicts the circuit interrupter in the tripped state.
Figure 5:
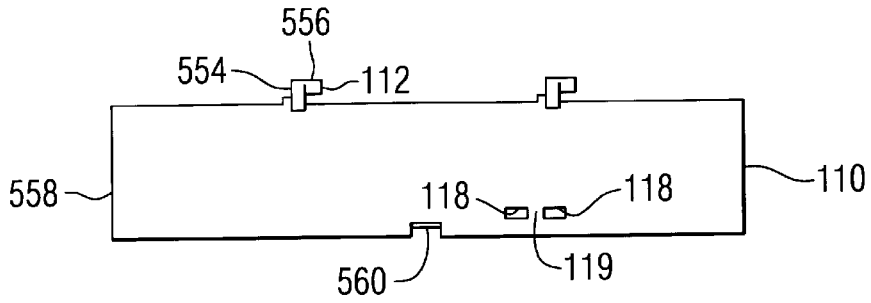
FIG. 5 shows a top view of the cover for the trip unit of FIGS. 1 through 4.

Referring now more specifically to FIGS. 2, 3 and 4, there are depicted a separable movable contact 28 disposed upon a moveable contact arm 32 and a fixed contact 30 disposed upon a fixed contact support or unshaped member 34. Line terminal 36 is disposed to the left in FIG. 2, for example, at the line end 15 of the circuit interrupter in a terminal cave or pocket 29. A load terminal 26 is disposed to the right in FIG. 2, for example, in a load terminal cave or pocket 29. To the left on the line terminal 36 is disposed a line terminal collar 38 which will be described in more detail hereinafter, and to the right is provided a load terminal jumper-to-movable contact arm conductor 802. Connected to conductor 802 is a flexible conductor 39, which is interconnected with movable contact arm 32 as shown schematically. The load terminal jumper or frame conductor 802 is interconnected at its other end with a bi-metal heater 180, which in turn is interconnected at its other end with the terminal 26. Consequently, when the circuit interrupter separable main contacts 28 and 30 are closed upon each other, there is a complete circuit through the circuit interrupter from right to left starting with line conductor 26 through bi-metal heater 180, through load terminal jumper or frame conductor 802, through flexible conductor 39, through the movable contact arm 32, through contact 28 to contact 30 and from there through the fixed contact support or u-shaped member 34 to line terminal 36.

There is provided a operating mechanism 20 for assisting in opening and closing the separable main contacts 28 and 30. In particular, the operating mechanism includes a cradle 52, which is pivoted on one end at a cradle fixed pivoted pin 54 by way of an opening 54A in the cradle for placement of the cradle fixed pivoted pin therein. The cradle includes a cradle-to-side accessory region side protrusion 55. There is provided an upper toggle link 46 and a lower toggle link 48. They are joined pivotally by an upper and lower toggle link pin 50. There is provided a lower toggle link to movable contact arm main pivot assemble attachment pin 56, which is affixed to the movable contact arm 32 at an opening 56A. There is also a cradle to upper toggle link pivot pin 58, by which the upper toggle link 46 is placed in physical contact with the cradle 52. There is also provided a movable contact arm main pivot assembly 59, which movably, rotatably pivots on a pivot 60. There is also provided a primary frame latch 62 which operates or rotates on a primary frame latch pivot 64. The primary frame latch 62 cooperates with a secondary frame latch 68, which rotates on a secondary frame latch pivot 70. The operating power for the tripping operating of the circuit breaker is provided by a charged main toggle coil spring 72. The main toggle coil spring is interconnected with a handle yoke 44 by way of a handle yoke attachment post 45. The other end of the spring 72 is attached to the toggle link pin 50. Cradle 52 has a cradle lip 73, which is captured or held in place by the primary latch 62 when the separable main contacts 28 and 30 are closed.

No tripping of the circuit breaker can take place by way of the operating mechanism until the aforementioned primary frame latch 62 has been actuated away from the cradle lip 73 in a manner which will be described hereinafter. There is provided a combination secondary-frame-latch-primary-frame-latch torsion spring 78, which exerts force against both latches sufficient to cause appropriate movement thereof at the appropriate time. The secondary frame latch has a laterally extending trip protrusion 79, the purpose of which will be described later hereinafter. Actuation of the primary and secondary frame latches occurs exclusively by way of the utilization of a resetable trip unit trip plunger 74, which is contained entirely within the removable trip unit 24. The trip unit trip plunger 74 is controlled or latched by way of a plunger latch or interference latch 75. The secondary frame latch 68 is in disposition to be struck by the moving trip unit plunger abutment surface 288. Upon opening of the separable main contacts 30 and 28, an electric arc is drawn therebetween which is exposed to an arc chute 77. The secondary frame latch 68 has a bottom portion 89, upon which is disposed an arcuate stop surface 90 for the primary frame latch 62. There is also provided above that arcuate stop surface and as part of the acruate stop member a latch surface 92.

The operating mechanism described herein may be the same as found in U.S. Pat. No. 5,910,760 issued Jun. 8, 1999 to Malingowski et al., entitled "Circuit Breaker with Double Rate Spring". Thought the primary and secondary frame latches are disposed within the case 12, the trip unit plunger 75 is responsible for initiating all tripping action from the trip unit 24 into the region of the secondary latch 68. Alternatively, the secondary latch 68 may be actuated by a push-to-trip button in a manner, which will be described hereinafter. The secondary latch 68 is actuated to rotate to the left as shown in FIGS. 2, 3 and 4, for example, in direction 81 about its pivot 70. As this occurs the acruate stop surface 90 for the secondary frame latch 68 rotates away from the bottom of the primary frame latch 62 until the lateral latch surface 92 rotates into a disposition to allow the bottom of the primary frame latch 62 to rotate to the right under the force of the cradle 72. This causes the primary frame latch 62 to clear the lip 73 of the cradle 52 to allow the cradle 52 to rotate upwardly about its pivot 54 in a direction 82 under the power of the now collapsing coil spring 72 by way of the force exerted thereupon by the upper toggle link 46 acting against the cradle-to-upper-toggle link connecting pin 58. As the toggle spring 72 relaxes, the upper and lower toggle links collapse, which in turn causes the lower toggle link to movable contact arm pivot assembly 56 to rotate upwardly in the direction 86 about its pivot 60. This, of course, causes the contact arm 32 to rotate similarly in the direction 88, thus opening the separable main contacts 28 and 30 and in most cases establishing an electrical arc of conducting electrical current there across. The action of the secondary frame latch 68 can be duplicated by causing secondary latch push-to-trip member side laterally extending trip protrusion 79 to rotate in the direction 81 by operation of a push-to-trip member which will be described later hereinafter. Resetting of the circuit breaker is accomplished in a matter well known in the prior art and described and shown with respect to the aforementioned U.S. Pat. No. 5,910,760. The important part of the operation with respect to this feature is the movement of the secondary frame latch point 76 in the direction opposite to direction 82, against the plunger face 288 in a manner, which will be described later hereinafter. However, if movement of the plunger face 288 in the rightward direction against its plunger spring, as will be described hereinafter, is prevented because of the latching of the plunger member 74, in a manner which will be described hereinafter, then the circuit breaker can not be reset. An important feature of the invention lies in the fact that the ultimate control of the resetting of the circuit breaker and tripping of the circuit breaker can be accomplished only from the removable trip unit 24, rather than from the operating mechanism 20.

Referring now to FIGS. 5 through 10, an embodiment of the invention is shown. In particular in FIG. 5, a cover 110 for the trip unit is depicted. Cover 110 may be transparent. Cover 110 has disposed thereon the previously described hinges 112, each having a cover attachment arm 554 for the L-shaped hinge 112 and an angularly off set trip unit attachment arm 556 therefor. Openings 118 and the bridge 119 are depicted. The side of the cover is indicted at 558, in addition there is provided a lifting region 560.

Figure 7:
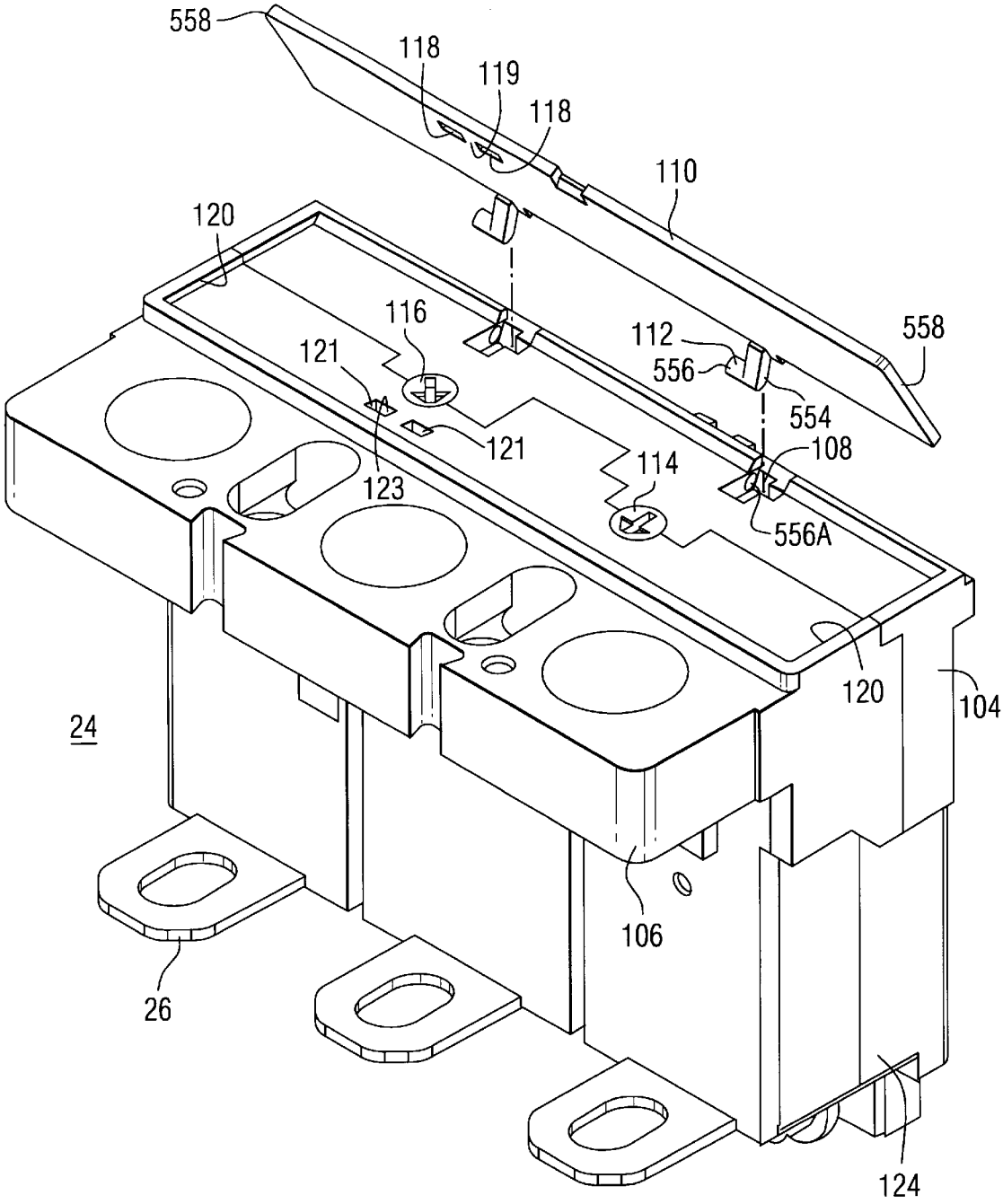
FIG. 7 shows an orthogonal view of the trip unit of FIGS. 1 through 4 with the cover separated away in an exploded view.
Figure 8:
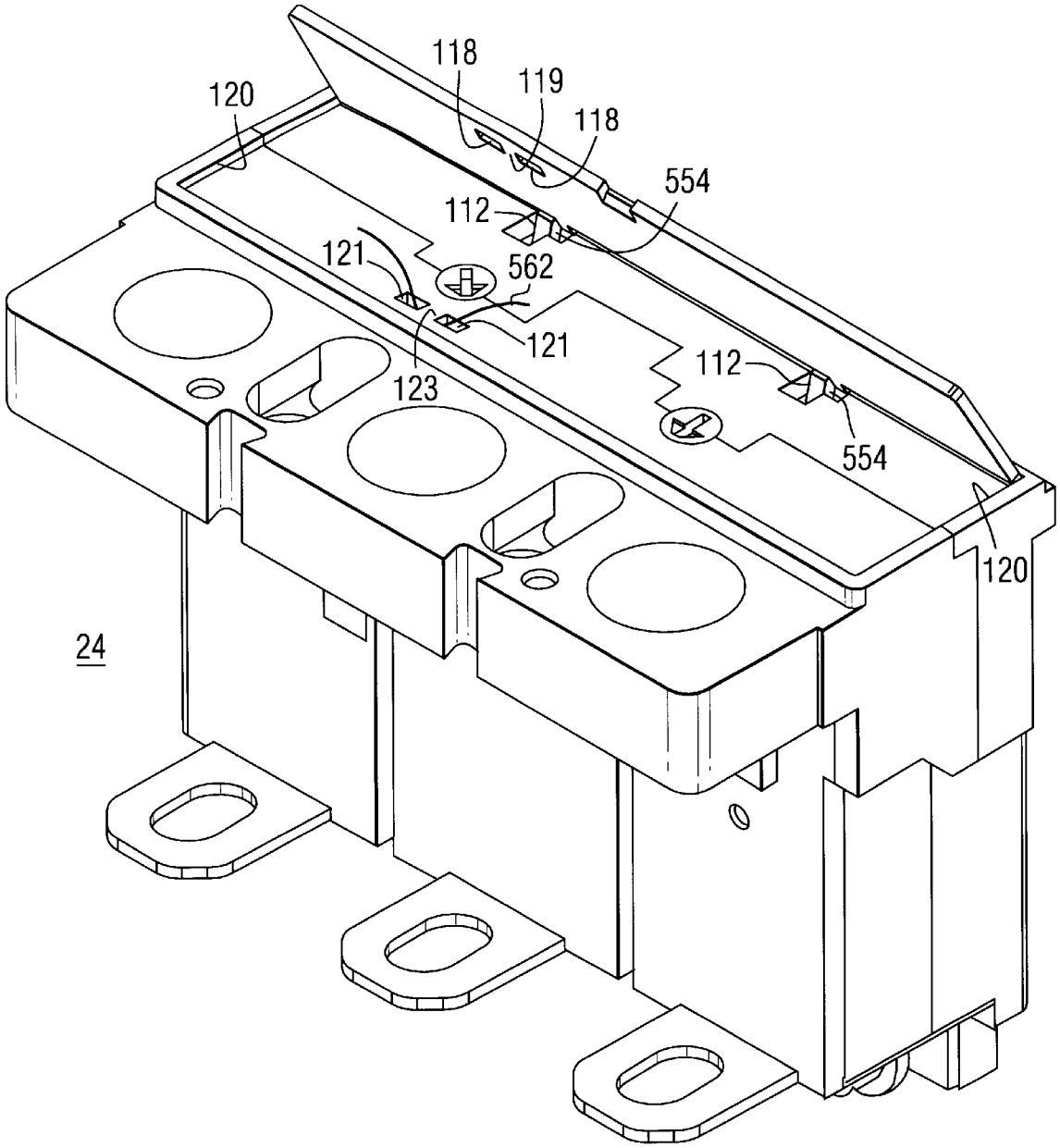
FIG. 8 shows an arrangement similar to FIG. 7, but with the cover disposed on the trip unit in an open disposition.
Figure 9:
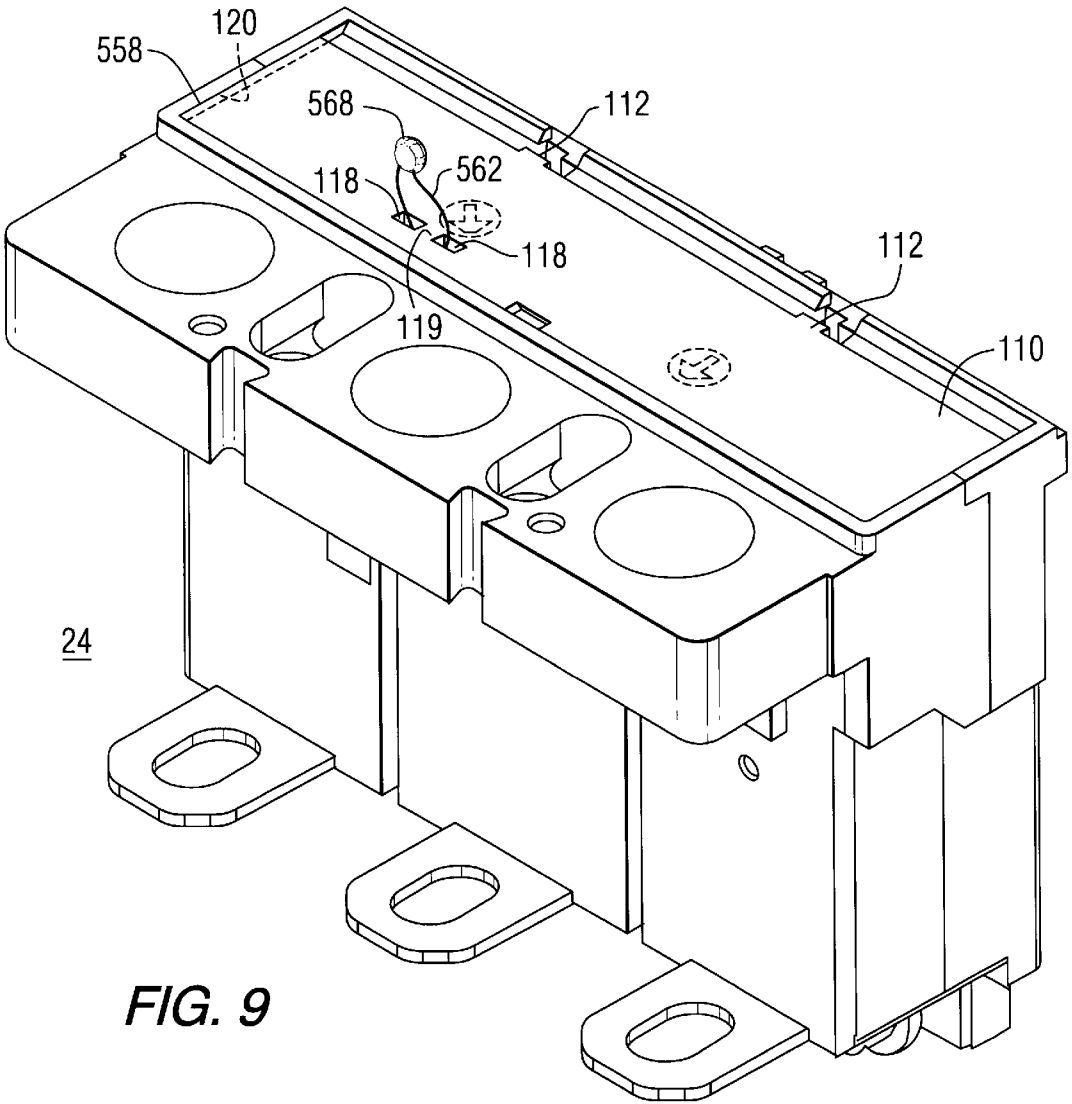
FIG. 9 shows an arrangement similar to FIG. 8, but with the cover closed.

Referring now to FIGS. 7 through 9, the trip unit 24 such as depicted earlier is shown with its cover 110 in a exploded disposition above the top of the trip unit 24. The cover 110 is inserted into the trip unit 24 by dropping it downwardly into the openings 108 to acquire a disposition shown in FIG. 8. At that point a two-ended wire 562 may be inserted into the holes or openings 121 under the bridge 123. Then the cover 110 may be rotated downwardly on members 556 and moved to the left into holes or openings 556A under the trip unit top, so that it rests snuggly between the ridges 120. At this point, the cover can not be removed vertically upwardly nor can it be slid other than between the ridges 120. The locking of the cover is completed by threading the ends of the wires 562 into the openings 118 and then joining them together with a solder seal 566 or similar locking arrangement above the bridge 119. The circuit interrupter cover 110 may now not be removed and thus the adjustments set on the adjustment members 114 and 116 shown directly under the cover cannot be changed, even though their location and thus their calibration can be noted.

Figure 6:
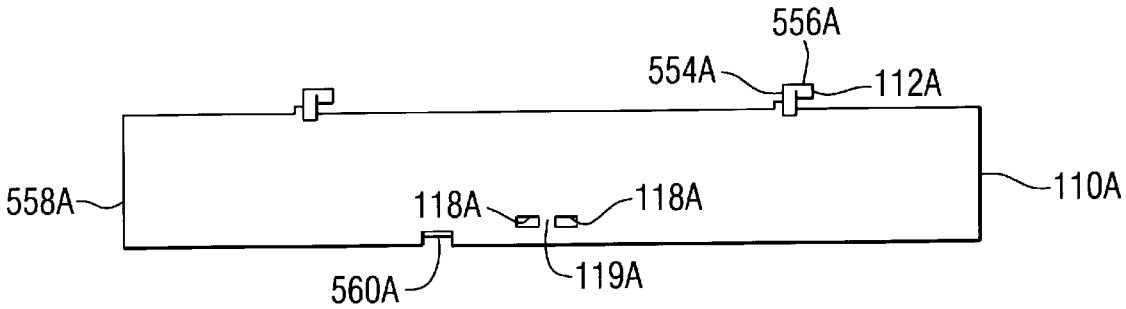
FIG. 6 shows a cover similar to that shown in FIG. 5 but for a four-pole trip unit.
Figure 10:
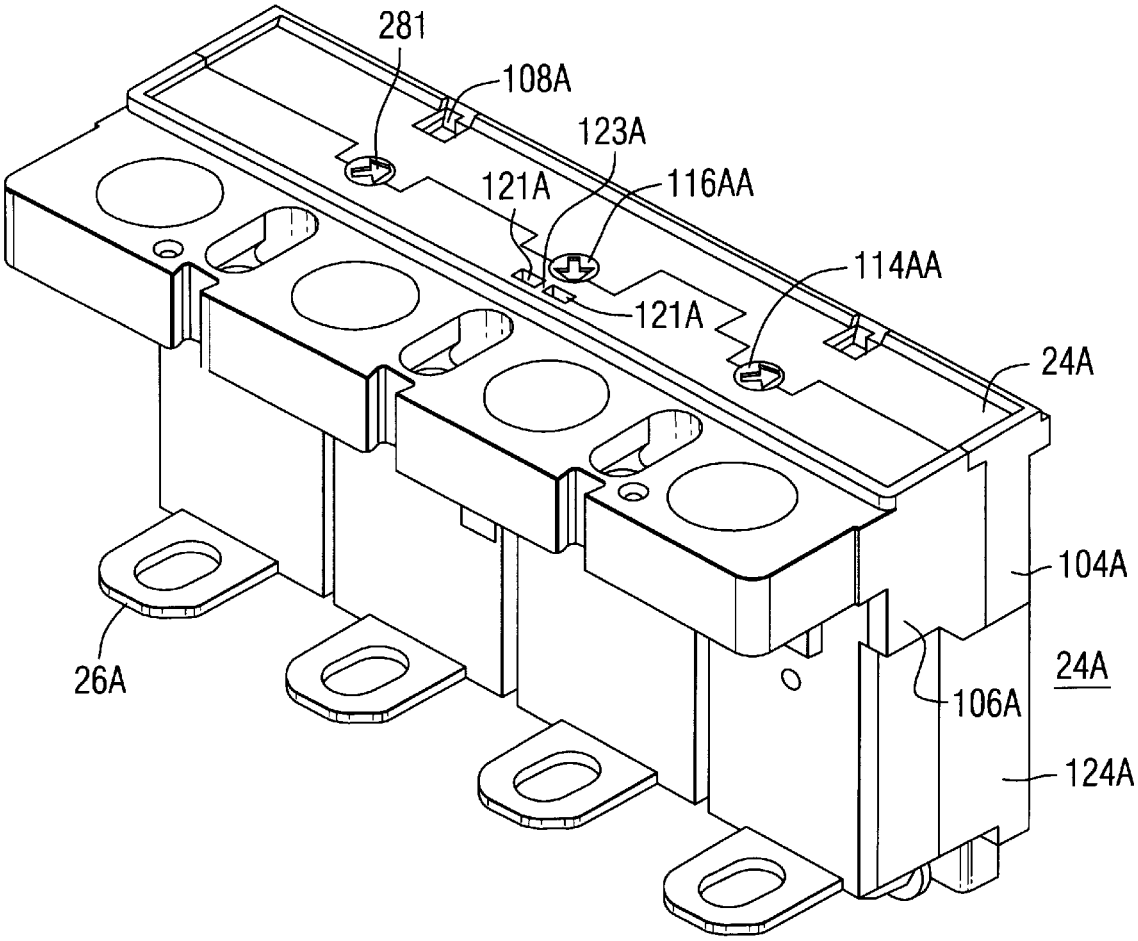
FIG. 10 shows a depiction similar to that shown in FIG. 7 for a four-pole trip unit.

FIG. 10 shows a similar arrangement of a trip unit for a four-pole circuit breaker, which would of course utilize the large cover arrangement shown in FIG. 6. Like reference symbols represent similar parts between the three- and four-pole versions. The letter capital 'A' is used for the four-pole version. With respect to the four-pole version of FIG. 10, a third adjustable trip member 281 is also shown.

What we claim as our invention is:

1. A circuit interrupter device, comprising:

a housing;

operating mechanism means disposed within said housing;

separable contact means disposed within said housing in cooperation with said operating mechanism means for being opened by said operating mechanism means;

adjustable trip unit means disposed within said housing in cooperation with said operating mechanism means for actuating said operating mechanism means for opening said separable contact means, said adjustable trip unit means having an adjustment means, an opening in said adjustable trip unit means through which said adjustment means is accessible from a region outside of said trip unit means for adjustment thereof, said adjustable trip unit means having a hinge means;

cover means disposed upon said trip unit means and affixed to said hinge means in either of two positions, the first of said two positions allowing removal of and insertion of said cover means from said hinge means and the second of said two positions preventing removal of said cover means from said hinge means, said cover means covering said opening when in said second position to prevent access to said adjustment means from said region outside of said trip unit means, and said cover means being non removable from said adjustable trip unit means at said hinge means in said second position; and separate lock means disposed on said cover means and said trip unit means for locking said cover means in said second position.

2. The combination as claimed in claim 1, wherein said adjustable trip unit means has a ridge there upon which abuts said cover means when in said second position for preventing sideways movement of said cover means upon said trip unit means.

3. The combination as claimed in claim 1, wherein said separate lock means is disposed in relationship to said cover means and said trip unit means to prevent hinged movement of said cover means relative to said trip unit means.

4. The combination as claimed in claim 2, wherein said separate lock means is disposed in relationship to said cover means and said trip unit means to prevent hinged movement of said cover means relative to said trip unit means.

5. The combination as claimed in claim 4, wherein said cover means means comprises an "I" shaped cover hinge member and said trip unit hinge means comprises an entrapping trip unit hinge opening, wherein said "I" shaped cover hinge member is insertable in a first direction into said entrapping trip unit hinge opening when the cover is in said first position and then moved laterally of said first direction for entrapping said "I" shaped cover hinge member therein, said cover means then being rotated upon said entrapped "I" shaped cover hinge member to said second position adjacent said ridge for being abutted thereby.

6. The combination as claimed in claim 4, comprising a wire with two ends, wherein said trip unit means has a bridged opening therein for entrapping said wire therein, wherein said cover means has a pair of holes therein through which said trip unit means entrapped wire protrudes at either wire end, solder lock means disposed to capture both said wire ends for completing a closed loop of said wire.

7. A circuit interrupter device, comprising:

a housing;

an operating mechanism disposed within said housing;

separable contacts disposed within said housing in cooperation with said operating mechanism for being opened by said operating mechanism;

an adjustable trip unit disposed within said housing in cooperation with said operating mechanism for actuating said operating mechanism for opening said separable contacts, said adjustable trip unit having an adjustment control, an opening in said adjustable trip unit through which said adjustment control is accessible from a region outside of said trip unit for adjustment thereof, said adjustable trip unit having a hinge;

a cover disposed upon said trip unit and affixed to said hinge in either of two positions, the first of said two positions allowing removal of said cover from said hinge and the second of said two positions preventing removal of said cover from said hinge, said cover covering said opening when in said second position to prevent access to said adjustment control from said region outside of said trip unit and to prevent removal of said cover at said hinge; and a separate lock disposed on said cover and said trip unit for locking said cover in said second position.

* * * * *